US005699906A

United States Patent [19]

Lombardo et al.

[11] Patent Number: 5,699,906

[45] Date of Patent: Dec. 23, 1997

[54] GOLF CLUB CARRIER

[76] Inventors: Carl Lombardo, P.O. Box 452, 70 St. John's Ave., Mt. Tabor, N.J. 07878; Peter Lombardo, 42 Ferncliff Rd., Morris Plains, N.J. 07950

[21] Appl. No.: 607,142

[22] Filed: Feb. 26, 1996

[51] Int. Cl.[6] ..... A63B 55/00

[52] U.S. Cl. ..... 206/315.3; 206/315.4; 206/315.5

[58] Field of Search ..... 206/315.1–315.8, 206/523, 372, 373; 280/DIG. 5, DIG. 6; 220/315; 292/86, 127, 135, 174

[56] References Cited

U.S. PATENT DOCUMENTS

| | | | |
|---|---|---|---|
| 3,534,795 | 10/1970 | Wiedenmeier | 206/315.6 |
| 4,319,616 | 3/1982 | Light | 206/315.6 |
| 4,383,563 | 5/1983 | Kirchhoff, Jr. | 206/315.2 |
| 4,767,001 | 8/1988 | Kim | 206/315.3 |
| 4,768,650 | 9/1988 | Chancellor, Jr. | 206/315.3 |
| 5,071,147 | 12/1991 | Stansbury | 206/315.2 |
| 5,123,531 | 6/1992 | Beretta | 206/315.5 |
| 5,267,660 | 12/1993 | Kwon | 206/315.6 |
| 5,458,240 | 10/1995 | Rich et al. | 206/315.6 |
| 5,465,839 | 11/1995 | Gretz | 206/315.3 |

*Primary Examiner*—Paul T. Sewell
*Assistant Examiner*—Luan K. Bui
*Attorney, Agent, or Firm*—Watov & Kipnes, P.C.

[57] ABSTRACT

A golf club carrier specifically designed for use on motorized golf carts that provides superior organization and individual club protection with a golf club position stabilizer at the top of the carrier with openings therein which are specific for each club; and a system of shaft and grip guides that direct each shaft to a specific position within the carrier housed in a rigid sided and rigid bottom carrier with spacious storage compartments on the front side of the carrier that is suitable for efficient use on the golf course and for security purposes when not being used or for travel.

7 Claims, 5 Drawing Sheets

Figure 4a
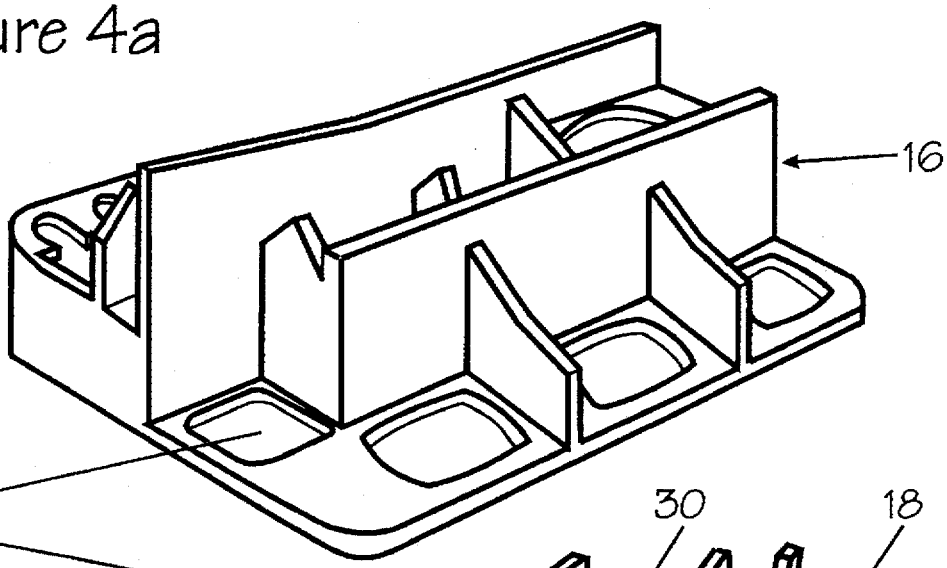
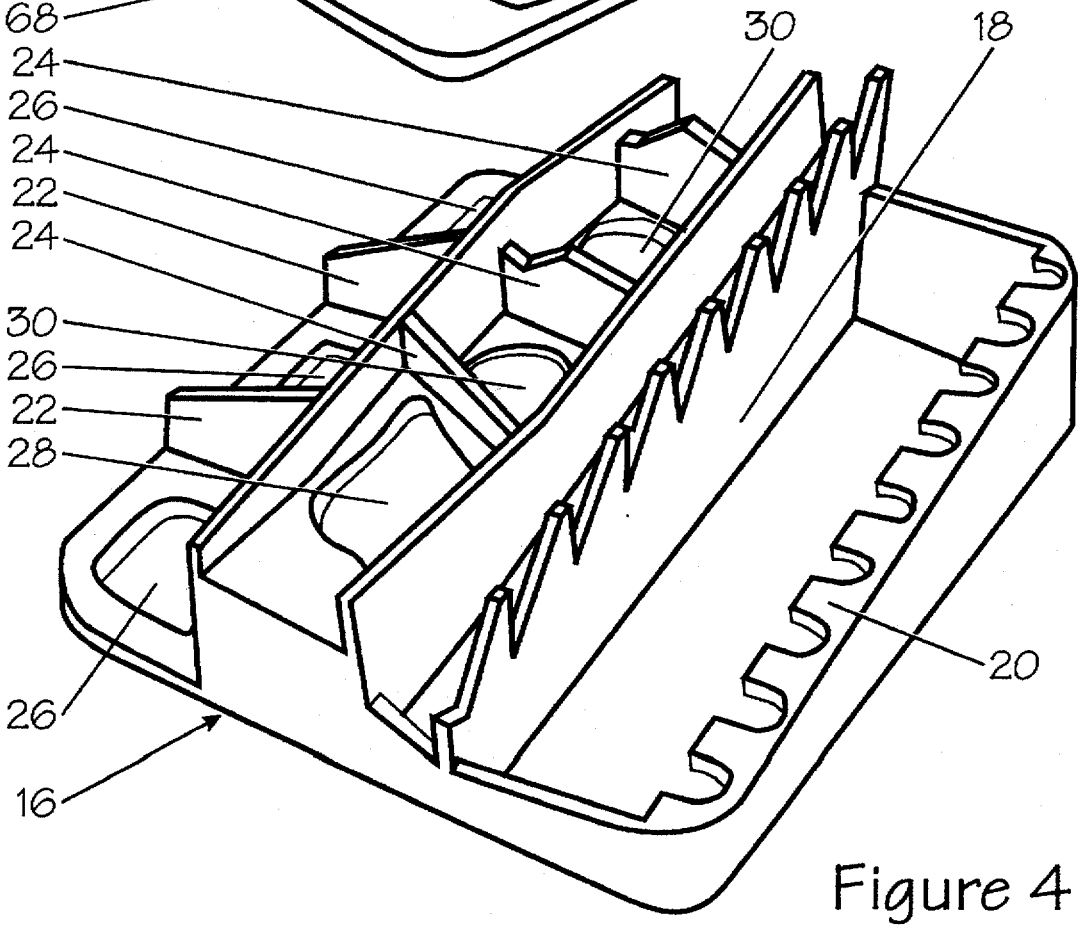
Figure 4

Figure 5a
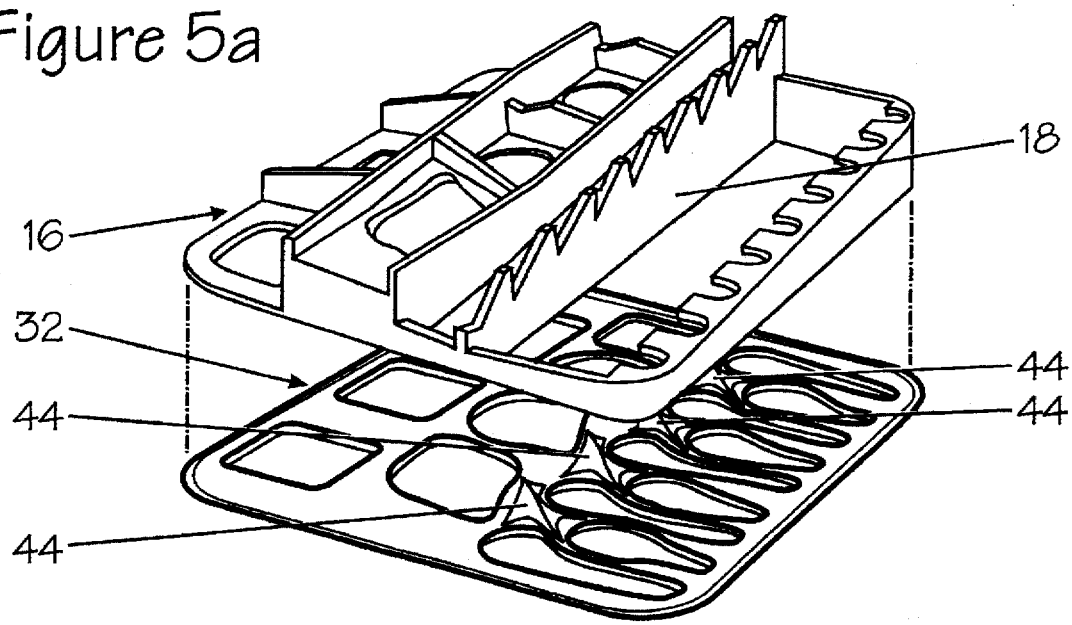
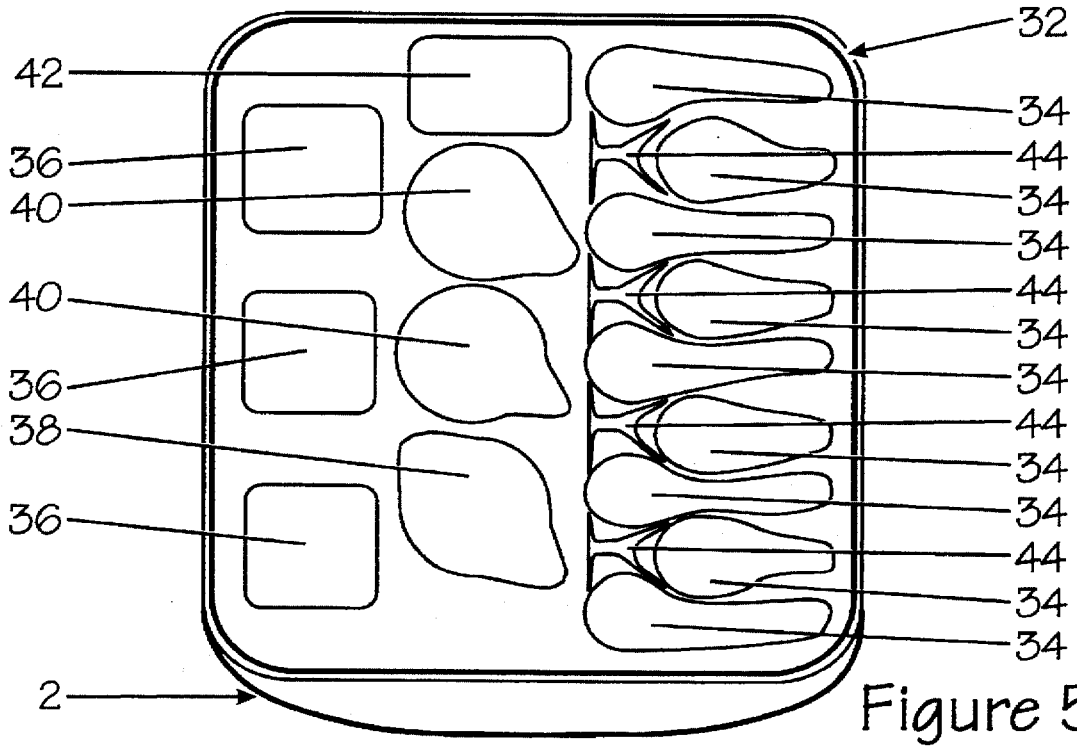
Figure 5

GOLF CLUB CARRIER

FIELD OF THE INVENTION

This invention relates to golf club carriers specially designed for use on motorized golf carts.

BACKGROUND INFORMATION

One of the more common problems facing golfers that routinely utilize motorized golf carts is that the majority of golf bags available today are designed to be carried over one's shoulder. The placement of this type of bag on a motorized cart brings a series of compromises that hamper the functionality of the bag. Because the vast majority of golf bags today provide 4 or 6 large openings at the throat of the bag, the heads of the golf clubs usually become entangled causing problems in club identification and extraction. With trends in golf currently promoting the larger style grips or jumbo grips, problems routinely arise in the extraction and insertion of clubs. It is very common to experience so much difficulty replacing a given club that it is often allowed to stick up out of the bag allowing it to work its way back down into the bag as the golf cart is driven over bumpy terrain. Another problem arises because the shafts are allowed to touch other clubs and the bag opening dividers. Whenever clubs, and more importantly the shafts, are allowed to touch other objects there is always present the risk that the new graphite or composite shafts can become scratched, cracked and eventually broken. Furthermore, it is desirable to not only protect the shafts but also the club heads themselves. These heads are often cast out of relatively soft metals which when banged against each other can dent and scratch one another. Some club heads have been chromed, and if this coating becomes chipped, the club head will then develop rust spots.

It is also true that because the bags do not have a specific place reserved for each club, but rather allow them to be placed in any of the openings, true accountability for each club is lost. This can become a problem especially riding in a motorized golf cart. On many golf courses, especially in and during wet conditions, golf carts are restricted to cart paths only. On many occasions it becomes necessary to take more than one club to the location of the ball. Once the shot is executed, the other club may very well be left behind. Once back to the cart, the clubs are returned to the bag. It may not be evident that a club has been left behind, and in fact, the club may not be discovered missing until the next time that club is chosen for a shot; and that may not happen for any number of holes. At this time it can be difficult to recall where the missing club was left.

More often than not, golfers today play golf with the aid of a powered golf cart. Resort golf courses require them and most country clubs and public golf courses encourage the use of them. This situation is brought about due to the lack of caddies, the usually undesirable situation of carrying ones own clubs and the need to speed up play due to the greater than ever number of golfers desiring tee times. As stated earlier, placement of a bag designed to be carried over one's shoulder, onto a motorized golf cart presents many compromises. Many times the bag is situated so that removal and replacement of clubs become difficult. Most golf bags are higher on one side of the throat area than the other. Usually this is the side that holds the wooded style clubs. When this side of the bag is situated on the cart facing rearward, access of the shorter iron clubs becomes extremely difficult. The higher wooded style clubs, especially when their protective head covers are installed, block easy view or access to them.

If the bag is oriented in the opposite direction, the wooded clubs become more difficult to access, as one must reach over the iron clubs. The iron clubs are in an easier position to access but because there is no order to the placement of the clubs, they normally tend to become entangled, making selection and removal of the desired club often a frustrating experience.

Another problem facing the golfer using a motorized golf cart is the problem of the storage pouch locations as related to their location on the bag when it is secured on the golf cart. With installation of the bag on the motorized cart, access to pouches on the backside (the side facing the front of the cart) becomes extremely difficult. In fact, one must usually remove the cart's strap and remove the bag; or at the very least, tilt the bag rearward to gain sufficient access to these areas. Even the storage compartments on the sides of the bag can be difficult to reach and access, owing to the close proximity of the other bag on one side and the side of the cart on the other.

Because the entire interior volume of the majority of golf bags today is dedicated to the golf club shafts, all storage compartments are attached to the outer perimeter of the bag. Put another way, the storage pouches' total space is limited because the storage areas can only extend a small amount beyond the outer circumference of the bag. If the storage areas are allowed to be any larger, the total circumference becomes too large creating a bag that is difficult to carry and difficult to attach to a cart. This situation severely limits the storage capacity of the bag. Because of this, golfers who travel with their golf bag often find that they need to carry an auxiliary bag to handle their accessories, such as shoes, towels, rain gear and sweaters. Also, because most golf bags are built with a soft flexible outer skin, they require a protective outer cover. This cover does little more than keep the golf bag within it clean, while adding substantially to the overall cost. As stated before, the standard style golf bag is an old design that just does not offer today's golfer the high-tech features that will improve the functionality of the bag and increase the ease with which a golfer can use the motorized cart and satisfy his needs for protecting and efficiently using his clubs while golfing as well as his needs for club security and for ease of traveling with his clubs.

Over the past sixty plus years there have been a whole host of attempts to correct this situation. Many have sought and received patents for improvements to existing equipment and still others have created entirely new designs quite practically reinventing the golf bag. While each of these improvements made strides beyond their predecessors, still the overwhelming majority of golf bags in use today resembles the tried and true conventional bag that has been popular for the past one hundred or so years. The mere fact that the original design is still the most popular indicates that even though many have tried, they still have not improved upon the original concept sufficiently enough to bring about change.

DESCRIPTION OF RELATED ART

Some designs address the shortcomings of the original by providing plastic tubes for the insertion of the club shaft in an attempt to organize the club heads for easy identification and removal. Some examples of bags that utilize this feature are U.S. Pat. No. 4,172,484, issued to Henning on Oct. 30, 1979; this bag contains honeycomb compartments to house club shafts. Another is U.S. Pat. No. 4,420,024 issued to Clayton on Dec. 13, 1983. This design used bundles of tubes stitched together to be folded in the desired shape. U.S. Pat.

No. 4,522,299 issued on Jun. 11, 1985 to Clarke, uses built-in guide channels within the core to help organize clubs. More recently U.S. Pat. No. 5,135,107, to Ingraham on Aug. 4, 1992 shows a bag that also uses parallel vertical tubes to separate the individual clubs, the main difference here being the height variations between irons and woods and the addition of a notch in the top of each of the tubes to help orient the club head direction. Granted, this is an improvement over prior art, but still no protection is afforded to the shaft as it still rubs against the tube's inner edge. Further, because the clubs are arrayed through the entire interior of the bag, no space is provided for the necessary storage pouches other than the space outside the perimeter of the bag.

Another group of designs not only uses tubes or guides but also employ spring clips to help hold the club shafts in place. While this can be effective, it is also heavy and costly to produce and, still worse, can scratch expensive graphite and composite shafts. U.S. Pat. No. 4,194,547 issued Mar. 25, 1980 to Sidor is an example of this type of design. U.S. Pat. No. 5,383,555 issued on Jan. 24, 1995 to Weinmeier is another example of a retro-fit design for golf bag organization. This design features a bolt-on frame that houses stair-step angular holders that array the iron clubs around the outer perimeter of the bag and house the wooded clubs in the center. While this design successfully limits the club heads from touching, it does little or nothing to protect the shafts of the clubs. In today's high-tech golfing world the shafts are commonly manufactured from expensive graphite and or exotic composite materials. These shafts are the most fragile and expensive component of the golf club. Also, because the clubs are held around the outer perimeter of the bag, it is all but impossible to use the rain club cover that is provided with the bag. Another patent, U.S. Pat. No. 5,029,703 issued on Jul. 9, 1991 to Dulyea, Sr. also uses a locking system to clamp the shaft and therefore restrain the club from moving about in the bag. Another patent, U.S. Pat. No. 5,279,414 issued on Jan. 18, 1994 to Brasher uses a different concept to hold golf clubs. This bag holds the clubs in the head down position. While this is not a new approach, it does present a novel attempt to immobilize golf clubs while within the bag. A major shortcoming of this design is the excessive wear and tear placed upon the head of the golf club, especially the wooded (metal) type club. Another shortcoming to this design is that the club head is down at the bottom of the bag and it is the head of the club that carries the identifying number that indicates which club it is. Still another shortcoming of this design is the total lack of storage space for accessories.

The next type of design includes U.S. Pat. No. 4,673,082 issued on Jun. 16, 1987 to Hemme. This design features a rotary carousel to allow the clubs to rotate to an opening running vertically down the side of the bag. This design also has problems in that a great deal of valuable space in the center of the bag is wasted. While it is true that the shafts don't touch one another, they do come in contact with clips and cut-outs on the carousel plates which will scratch and mar the finish on the shaft. Further no attempt to keep the heads from touching has been made. U.S. Pat. No. 4,915,221, issued on Apr. 10, 1990 to Spangler also uses the rotary design but this design adds the element of a covered top and club grip receptacles that angle out the vertical opening to aid in the removal of the desired club. While this design appears to be superior to the previously cited example, it also suffers from the poor use of available space problem. In fact, the putter, balls and other accessories must be carried in an auxiliary compartment attached outside the limit of the bag. The center space goes completely unused and because the clubs rotate around the outer circumference of the bag there is no room for accessory storage bins. Further, when this style bag is strapped into a golf cart, the strap itself prohibits the removal of the clubs. This design will not work on a golf cart without extensive modification to the golf cart's bag strap system.

The next group of golf bag patents deals with hard-sided bags that are basically a soft-sided design golf bag done in a rigid plastic material that will provide improved protection to golf clubs while traveling to and from the golf course. U.S. Pat. No. 4,905,827, issued Mar. 6, 1990 to Kim is an example of prior art of this category of bag. While it is true that this style bag will afford increased protection over a soft-sided bag, and also allows some storage capacity, it really does not address the problem of individual club protection. Each club is allowed to bang and hit against one another. So even though this design provides protection to the set as a whole, no special attention is paid to each club itself. Another design, U.S. Pat. No. 4,383,563 issued to Kirchhoff, Jr. on May 17, 1983 depicts a hard-sided bag that was designed primarily as a golf bag to be carried. This bag provides tubes for each shaft and cradles for the club heads. While this design incorporates many desirable features, it also has major drawbacks within its design. First, the sheer size of this bag will not allow convenient use on a motorized golf cart. The strap that secures the bag to the cart cannot surround the bag and reach the clamping device. Second, even though this is one of the largest bags designed, it is also one of the least efficient in the use of its available space. The greatest portions of the storage compartments extend outside the outer perimeter of the bag; therefore, as this bag is intended to provide protection during air travel, much damage may be inflicted to the storage compartments and so to their contents. Also, because of the poor use of space, the deck area on top, even as large as it is, can only store fourteen clubs. Yes, while it is true that the U.S.G.A. rules only allow fourteen clubs for sanctioned tournament play, many weekend golfers today routinely carry more than fourteen clubs. Third, this bag design incorporates many moving parts which require much higher cost to produce and much greater weight. Fourth, even with its hard-sided construction, no provision has been made for a locking top or locking storage bins. And fifth, the design has storage bins on both the front and the back of the bag, thereby creating problems accessing the storage areas at the back of the bag if it was attempted to be attached to a motorized golf cart.

Another group of golf bag designs have set out to correct the inherent problems when golf bags designed to be carried are placed on a motorized cart. Because these bags were designed to be carried, and not clamped into a golf cart, little thought was given to the location of the accessory pouches. In fact, they were placed wherever there was adequate space. Now that this bag is strapped to a motorized golf cart, no matter how the bag is positioned in the cart there is always a pouch in a position that is extremely difficult to reach. Many designs have been developed to correct this shortcoming, one example of which is U.S. Pat. No. 5,123,531 issued on Jun. 23, 1992 to Beretta. This design is basically a standard looking soft-sided bag, without a shoulder strap attached to it and that has a sloped opening at its top. The main claimed advantage is that the user should find it easier to extract and replace a desired club, even though no attempt was made to organize or protect the club heads or shafts. Other designs have been presented which seem to share the same common design feature of placing storage pouches in more convenient locations for easier access. U.S.

Pat. No. 4,796,752 issued on Jan. 10, 1989 to Reimers is an example of a bag designed for use on a pull or motorized golf cart. His bag does not offer any advantage in use on a motorized cart with the possible exception of the placement of the side pouch. Again, as in earlier detailed prior art, one or two of the design faults are addressed, but still other problems exist with the golf bag design of this patent.

Still other designs exist that attempt to improve the storage capacity of golf bags. U.S. Pat. No. 4,319,616 issued on Mar. 16, 1982 to Light is an interesting design that takes the area that is usually dedicated to golf club shaft storage in the center of the bag and uses it as storage compartments. The golf clubs are arrayed in a horseshoe pattern around the sides and back of the bag. Storage capacity is increased but the overall size of the bag is equally increased. No complete shaft protection is afforded, and the club heads are allowed to make contact with each other. The club capacity is limited to fourteen clubs and no security or travel capabilities have been designed or considered. U.S. Pat. No. 5,402,883 issued on Apr. 4, 1995 to Shin is a golf bag that has larger pouches, but they are arrayed around the perimeter of the bag in standard fashion. One of the unique features of this design is the removable storage bags within the compartments. Again, this design does little or nothing to protect or in any way improve the condition of the club shafts or inhibit the club heads from making contact with each other. No protection, security or travel features have been included.

SUMMARY OF THE INVENTION

In accordance with the present invention, a new and improved golf club carrier, generally rectangular in shape with a rigid upper area, primarily for use on a motorized golf cart is disclosed. The improved golf club carrier embodies many new concepts to completely revolutionize golf bags used in conjunction with motorized carts. At all times, the golfer using the carrier has true and complete protection of his clubs and carrier content, total accountability of his clubs, and easy access to all of his accessories to aid him in his round of golf. This one carrier satisfies all of the golfer's needs. The carrier provides the golfer who uses a motorized golf cart the best possible alternative to the conventional round golf bag. The carrier is suitable for everyday use at the club. It can be either housed at the golf course bag storage room, locked if so desired, or placed in the trunk of an auto. The carrier is perfect for the golfer going on vacation. It can be locked and placed on an airplane or train for travel, used on a cart at a resort golf course and returned home to be used the next day at the golfer's home course.

It should be apparent to those skilled in the art, after a review of the specification and the description of the drawings which follows that a unique golf club carrier capable of achieving the above-stated objectives (as well as other objectives) has been disclosed. A main object of this invention is to protect all aspects of the golf clubs and contents of the carrier during transportation to and from and while in use on the golf course while providing superior organization and accountability. Further, it is intended to eliminate the difficulties in finding the correct club for use and replacing the club when clubs and shafts and grips become entangled as they do in a conventional golf bag. In addition, the design allows greater storage capacity than conventional golf bags due to the fact that there are internal storage compartments. The golf club carrier is constructed from a minimum number of parts and its style allows it to conform to the look of traditional design.

Another main object of the invention is to provide superior protection of the contents of the golf bag carrier, particularly with regard to protecting the golf clubs themselves, especially golf clubs fashioned with shafts and/or club heads made from costly materials such as those with graphite or composite shafts and/or with club heads cast out of relatively soft metals or with club heads that have been chrome-plated.

BRIEF DESCRIPTION OF THE DRAWINGS

FIG. 4 is a large perspective view of the club rack.

FIG. 4*a* is a smaller reverse perspective view of the club rack showing the opposite side.

FIG. 5 is a top elevation view of the deck section of the golf club carrier.

FIG. 5*a* is a smaller perspective view of the club rack shown raised above the deck section of the golf club carrier and illustrating their relationship to each other.

DETAILED DESCRIPTION OF THE DRAWINGS AND OF THE PREFERRED EMBODIMENTS

Figure 2:
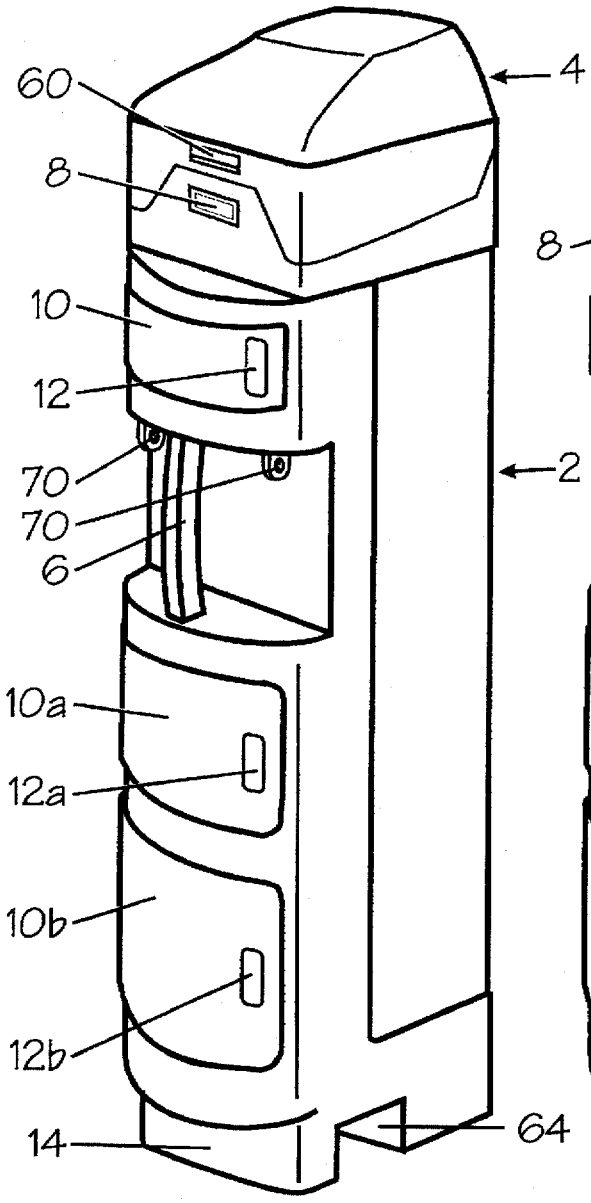
FIG. 2 is a view of the golf club carrier with the same perspective as FIG. 1, with the doors and top secured and locked in place.
Figure 2A:
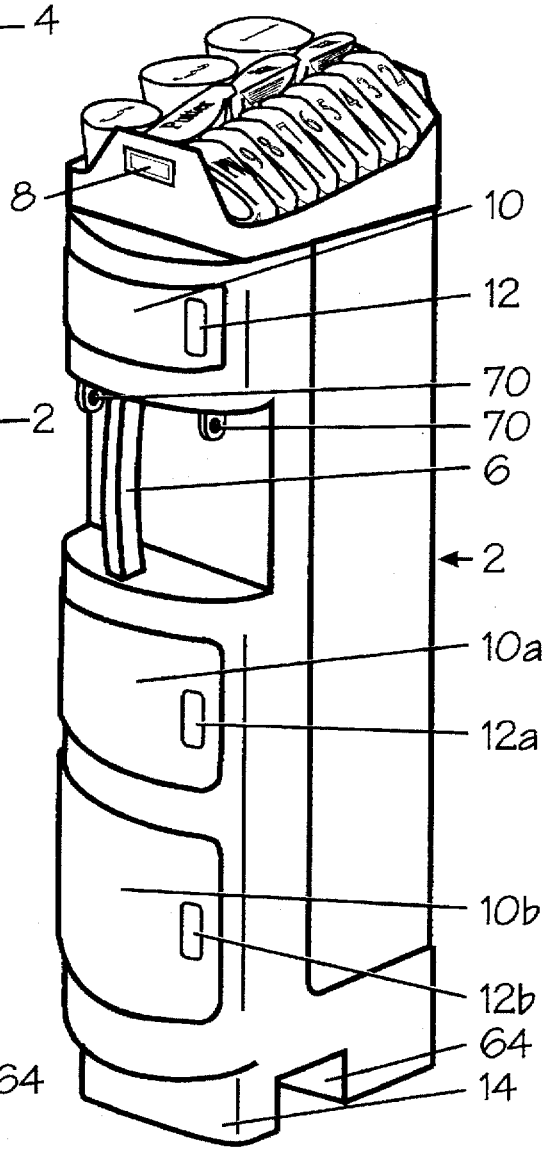
FIG. 2*a* is a view of the golf club carrier with the same perspective as FIG. 1, with the top removed showing the golf clubs arrayed in the rack.

Specifically, the club carrier design incorporates a completely new top deck 32 that houses or supports a rack unit 16 that holds each club head in a secure separate position. The top deck 32 has openings for various isolation tubes 56; isolation tube openings 34 for the iron style clubs, openings 36 for the wooded style clubs, opening 38 for the putter, openings 40 for utility clubs such as chippers, sand wedges, or utility wooded style clubs, and opening 42 for the umbrella. Also housed on the deck 32 are raised guides 44 thereon at the top of the deck to assist in directing the butt ends of the iron style golf clubs through the isolation tube openings 34 and into the proper isolation tubes 56 in the sequence as shown in FIG. 2*a*. When the iron style clubs are settled into their respective openings in hosel holder 20, they are held in numerical sequence in slots of the club head holder 18 on the rack 16, as illustrated in FIG. 2*a*. Contact of the iron club heads with the surface of club head holder 18 is minimal.

As to the rack unit, the golf club shafts are inserted through differently numbered openings into the isolation tubes 56, which tubes are open at their top on said top deck 32 and extend in a relatively parallel direction to an integral bottom portion of the carrier beginning at the back of the carrier and moving to the front of the carrier 2; with openings 30 designated for utility clubs, openings 26 designated for wooded style clubs, opening 28 designated for the putter and opening 68 for the umbrella. It will be noted that the openings for the iron style clubs and the openings for the wooded style golf clubs are arrayed on the opposite sides of the deck and rack units. There are divider partitions 22 between the wooded style clubs to restrict contact between club heads and partitions 24 to isolate the utility club heads from contact with other club heads.

The complete rack unit 16 in the preferred embodiment will be molded in a semi-rigid, high impact synthetic resin material similar to the type used to form rigid luggage, optionally containing one or more strips of soft synthetic foam to lessen the already minimal shock to the club heads.

Figure 1:
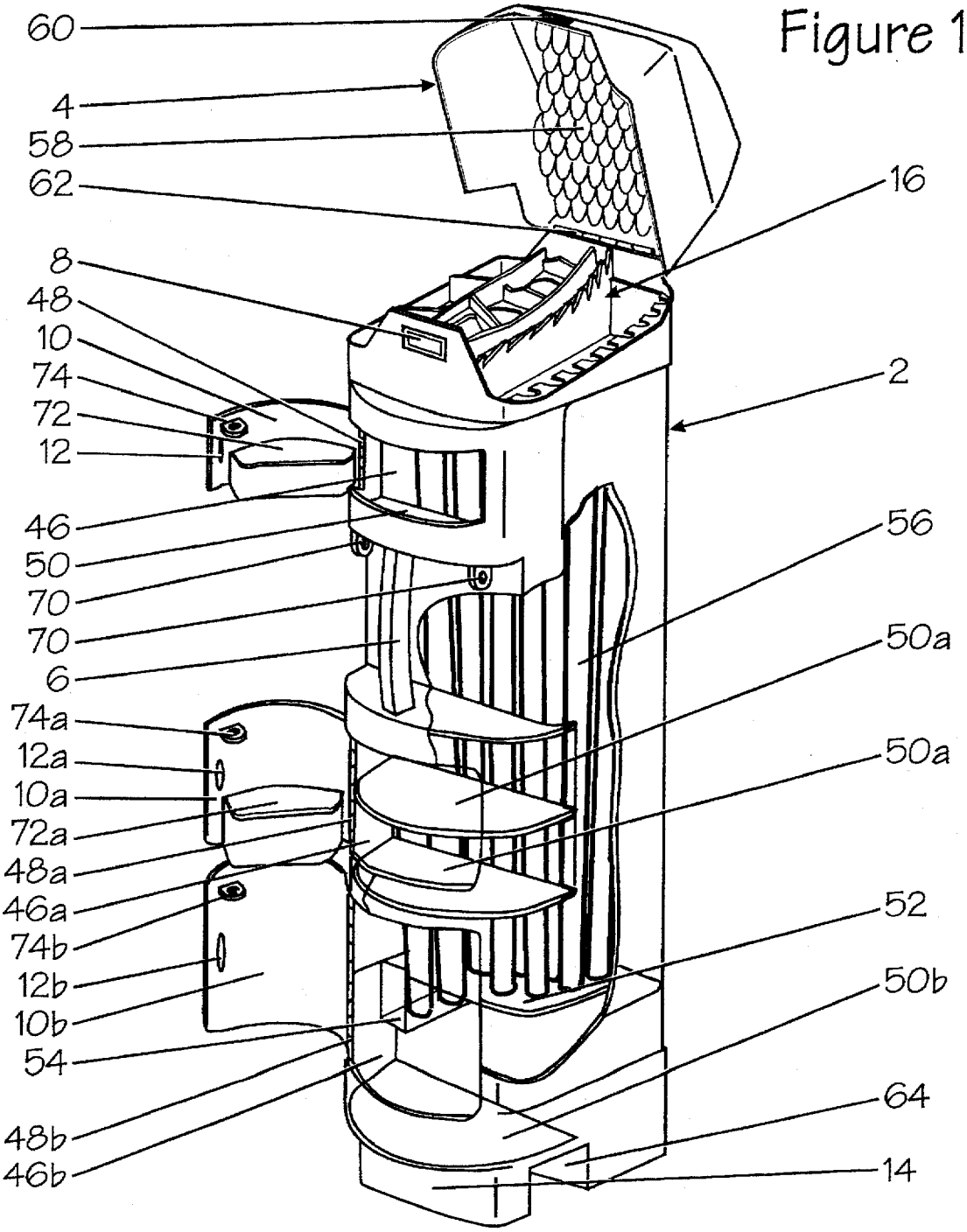
FIG. 1 is a perspective view of the golf club carrier provided in accordance with principles of the present invention, with the top and doors open and a cutaway to expose the internal isolation tubes.

Each club shaft is provided its own semi-rigid tube 56 to isolate it from contact with other club shafts. These isolation tubes 56 are attached toward the bottom of the carrier in separate support groupings: supporting grouping 52 for the iron style clubs and support grouping 54 for the wooded style clubs, as shown in FIG. 1. Each golf club shaft is guided down an isolation tube 56 toward the bottom of the carrier 2. In this manner, each golf club, especially the shaft, is protected from touching either another club or the carrier 2 except where they are designed to come into contact. Only the club grip top can touch the side of the isolation tube 56 and only the top area of the club is allowed to touch the rack slots in club blade holder guide 18 and the openings in hosel holder 20 of rack unit 16 that keep the club heads separate.

In structure, the golf club carrier possesses a closed rigid bottom which is integral with sides which are rigid toward the bottom of the carrier. Said sides of the carrier are fixedly attached to upper deck 32, which deck, along with rack unit 16 on the top of same, houses individual spaces for the golf clubs to be transported in the carrier.

The golf club carrier also features storage areas which are unique and spacious. As shown in FIG. 1, these include an upper storage area 46, a middle storage area **46*a* and a lower storage area 46*b*. All of the storage areas are advantageously located in the front of the carrier 2 to provide easy and direct access when this carrier 2 is installed on a cart. Situated in the center of the front of the carrier 2 is a handle 6. On the underside of the area above the handle 6 are located two "D" rings 70. These rings 70 allow for the attachment of items such as a golf towel and an ID tag. In the enclosed bottom of this carrier 2 is an indentation or recess 64 to allow clearance of the rear bumper on a motorized golf cart, creating a support leg 14** in the front section.

In the upper area of the carrier 2, there is a storage compartment 46 that houses balls, tees and the other small items used during the round. In the lower portion of the carrier 2, there are two larger storage compartments **46*a* and 46*b* to house the items not readily necessary, such as shoes (golf or street), sweaters, additional balls, rain gear, towels and any other items that the individual deems desired. Each of the three storage areas 46, 46*a*, and 46*b* has a door 10, 10*a*, and 10*b* with latches 12, 12*a*, and 12*b* respectively to provide security for the contents. Doors 10, 10*a*, and 10*b* pivot around vertically extending door hinges 48, 48*a*, and 48*b* respectively, for opening and closing purposes. Located on the rear side of the two uppermost doors 10 and 10*a* are storage compartments 72 and 72*a*** to house small items such as golf tees, ball markers, ball mark repair tools and any other small item stored within the carrier.

Figure 3:
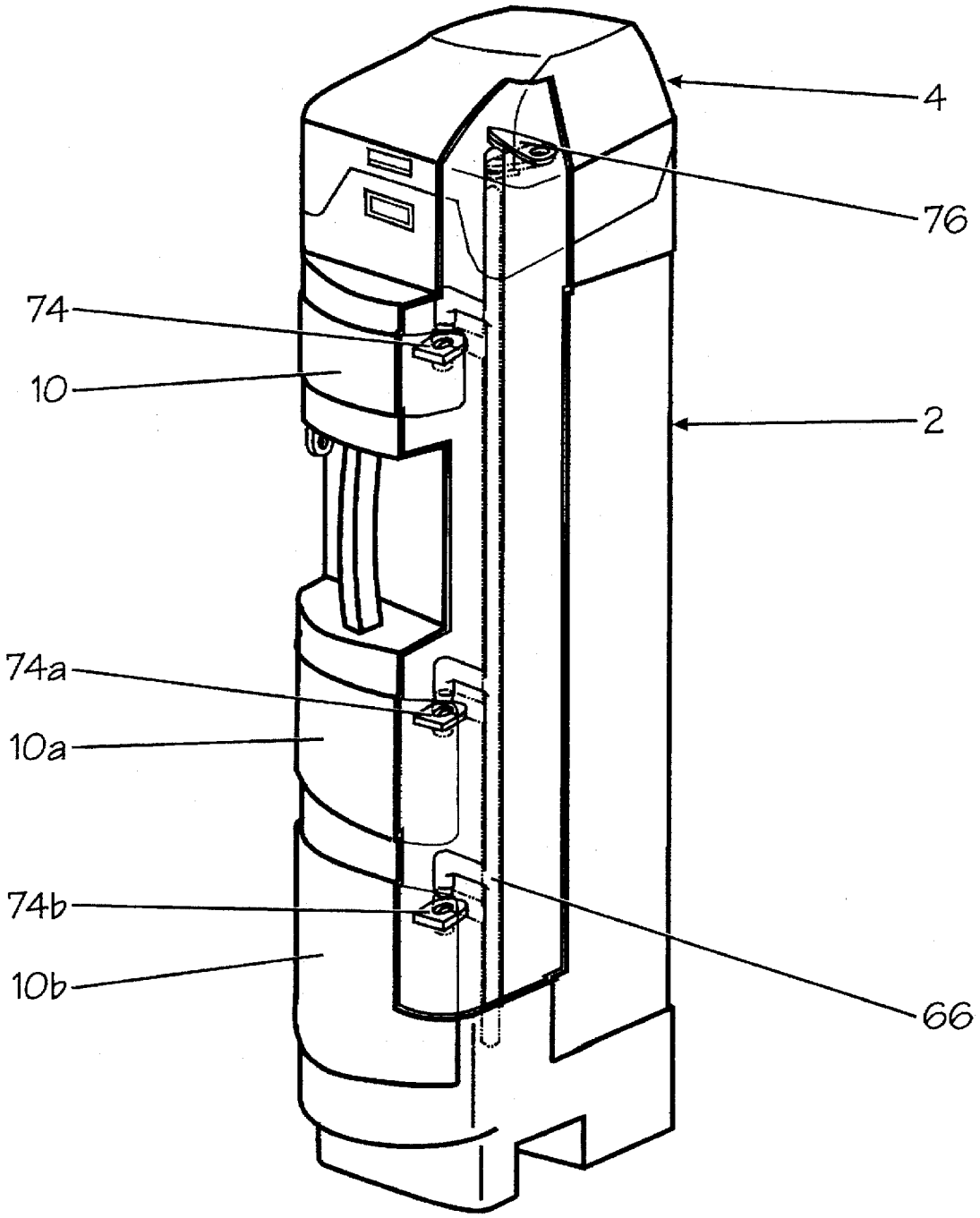
FIG. 3 is a view of the golf club carrier with the same perspective as FIG. 1 showing a cutaway view of the locking mechanism.

Each of the three doors has a lock attachment ring 74, **74*a*, and 74*b* respectively attached to the inside section of the door. These rings work in conjunction with a locking mechanism 66 (FIG. 3) that connects to each door to provide security and inhibit the door from opening. Located in the front area of the rack 16 is a locking mechanism on/off control 76** to allow the locking mechanism to be active or inactive.

At the top of the carrier 2 there is a hinged removable top 4 lined with a foam material 58, which top opens to the rear. This top 4 is held in place with a releasable hinge 62 so that the top 4 may be removed if desired or allowed to remain in place. This top 4 provides an excellent rain cover for the clubs in the event of rain showers. This top 4 is held in place at the front of the carrier by a latch 60. This latch 60 is attached to a locking mechanism 8. Internally situated within the carrier 2 and the top race 16 area is a door locking mechanism 66 and the locking mechanism on/off control 76. When this lock 66 and on/off control 76 are set, the storage compartments 46, **46*a*, and 46*b* are locked, restricting their ability to be opened. In conjunction with this lock 66, when the top 4 is also locked by 8**, the carrier is secured and ready for travel.

The ideal embodiment of this carrier 2 is a rigid upper area and a rigid lower area attached to sides and back connecting same and a front side of the carrier with the features and storage areas as above described. It is possible to incorporate semi-rigid side members to maintain a more traditional look. Because the shorter shafted irons are preferably oriented on the top rack 16 at the same height as the longer wooded clubs, storage area **46*b* created in the lower well of the carrier 2 is large and spacious. In conjunction with this, the isolation tubes 56 for the irons are set at an angle to the rear and sides of the carrier 2. This configuration combination is the most efficient use of space of any golf club carrier design today. Because the front side of the carrier 2 is designed to extend outward, the total storage area 46, 46*a*, and 46*b* is impressive. There are multiple levels and storage shelves 50, 50*a*, and 50*b* in the upper, middle, and lower compartments 46, 46*a*, and 46*b*. The bottom or the lower storage area 46*b* provides space for a pair of shoes. These can be oriented on their sides with the spikes, or soles, facing outwards. In fact, there is so much space available in compartment 46*b*, that two pairs of shoes can be stored within. This design is not only very space efficient, but also very cost efficient as well. There is a minimum of moving parts. In fact the only components that move are the doors along with their latches, and the top 4 and the latch 60, along with the lock mechanisms 8 and 66**.

It should be now apparent that the golf club carrier as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

We claim:

1. A golf club carrier specially designed for efficient use on a motorized golf cart and to satisfy a golfer's needs for protecting and efficiently using the clubs while golfing, as well as his needs for club security, and said carrier having a front side, a back side, and side members, comprising:

a closed integral bottom portion having an indentation in its undersurface to allow clearance of the bottom of the carrier over the rear bumper of a motorized golf cart when the carrier is installed thereon, said carrier also having rigid lower portion sides connected to the side members of the carrier, said side members being fixedly attached to an upper deck which houses individual spaces for golf clubs and which deck has a golf club position stabilizer affixed thereon;

a series of isolation tubes internally situated within the carrier which open at their top on said upper deck and extend in a relatively parallel direction to said integral bottom portion of the carrier;

a top cover attached on the back side of said carrier by means of a releasable hinge device and connected in the front to said carrier with a latch means such that said top is moveable between an open position adjacent to the back of said side members and a closed position covering said upper deck and said golf club position stabilizer; and wherein the front side of the carrier has storage compartments and doors to provide easy access to the contents of the storage compartments when the carrier is installed over the rear bumper of a motorized golf cart, each of said doors being attached to said front side of the carrier by means of a vertically extending hinge device along one side and a latch means on the other side allowing said doors to rest in an open position for access or in a closed position for security, and each of said doors being further attached to a locking device that when set in the locked position restricts said doors from opening and when set to the open position allows access to said compartments.

2. The golf club carrier according to claim 1, wherein the upper deck also houses an individual space for the insertion of a golf umbrella.

3. The golf club carrier according to claim 2, wherein said lower portion and said top cover are formed from a high impact synthetic resin material.

4. The golf club carrier according to claim 2, wherein said lower portion and said top cover are generally rectangular and the interior of said top is lined with a soft foam material.

5. The golf club carrier according to claim 2, wherein said top cover latch means is connected to a locking mechanism.

6. The golf club carrier according to claim 2, wherein the storage compartments on the front side of the carrier are of variable and different capacities and contain various ledges and divider panels which allow a variety of golf related equipment and supplies to be efficiently stored and retrieved for use.

7. The golf club carrier according to claim 2, wherein the front side of the carrier has a handle centrally located thereon and also D-shaped rings near the top of the carrier for the attachment of towels and various identification tags.

* * * * *